United States Patent [19]

Giorgio et al.

[11] Patent Number: 4,932,076

[45] Date of Patent: Jun. 12, 1990

[54] FIRE FIGHTER HELMETS

[75] Inventors: Hugo Giorgio, Etobicoke; Robert G. Martindale, Oshawa, both of Canada

[73] Assignee: Safeco Mfg. Limited, Scarborough, Canada

[21] Appl. No.: 279,706

[22] Filed: Dec. 5, 1988

Related U.S. Application Data

[62] Division of Ser. No. 75,960, Jul. 21, 1987, Pat. No. 4,829,599.

[51] Int. Cl.[5] ..... A42B 3/00

[52] U.S. Cl. ..... 2/5; 2/414; 2/416; 2/423

[58] Field of Search ..... 2/414, 5, 6, 7, 8, 416, 2/423

[56] References Cited

U.S. PATENT DOCUMENTS

| | | | |
|---|---|---|---|
| 1,835,883 | 12/1931 | Lewis | 2/5 X |
| 2,665,422 | 1/1954 | Green et al. | 2/416 |
| 2,923,941 | 2/1960 | Roth et al. | 2/416 |
| 3,040,329 | 6/1962 | Ruggerio | 2/416 |
| 4,051,555 | 10/1977 | Daly | 2/6 X |
| 4,091,469 | 5/1978 | Davidson | 2/423 X |
| 4,286,339 | 9/1981 | Coombs | 2/414 |
| 4,573,217 | 3/1986 | Reed | 2/7 |

FOREIGN PATENT DOCUMENTS

| | | | |
|---|---|---|---|
| 801321 | 9/1958 | United Kingdom | 2/414 |

*Primary Examiner*—Wm. Carter Reynolds
*Attorney, Agent, or Firm*—Fetherstonhaugh & Co.

[57] ABSTRACT

In a fireman's helmet of the type having an outer shell and an impact resistant inner shell and a liner which has an upper band portion and an apron portion extending a substantial distance below the upper portion, the improvement wherein the upper band portion of the liner is arranged to extend around a lower marginal portion of the inner shell and is clamped between the lower marginal edge portion and an opposing face of the outer shell to be retained therebetween. A suspension anchor is provided for securing the head mounting harness to the impact resistant inner shell which comprises a short strap of a substantially rigid material having a sufficient length to extend through a mounting loop formed at the end of a web of the mounting harness. The short strap has a pair of anchoring legs projecting therefrom at opposite ends thereof which have sufficient length to project into the body of the inner shell to anchor the harness which is supported by the short strap in use. The anchoring legs which project from the short strap have a greater length than the gap which is formed between the inner and outer shells of the helmet thereby to prevent the removal of the suspension anchors while the inner shell is nested in the outer shell.

12 Claims, 4 Drawing Sheets

FIRE FIGHTER HELMETS

CROSS-REFERENCE TO RELATED APPLICATIONS

This application is a division of Application Ser. No. 07/075,960 filed July 21, 1987 which has issued as U.S. Pat. No. 4,829,599 dated May 16, 1989.

FIELD OF INVENTION

This invention relates to a fireman's helmet. In particular, this invention relates to improvements in the mounting of liners and the suspension harness of fireman's helmets.

PRIOR ART

Fabric liners have been used on fireman's helmets for some time for the purposes of bridging the gap between the helmet and the protective clothing worn by the fireman. In order to secure the liner, it is the normal practice to locate a portion of the liner inside the inner shell and to secure it to the inner shell by means of the suspension harness. The webs of the suspension harness are threaded through apertures formed in the liner. This method o mounting the liner makes it difficult for the fireman to remove the liner from time to time.

The liners can become soiled very easily in use because of the environment in which the fireman is required to work and consequently, it is important that it should be easy to remove the liner so that it can be replaced without requiring special tools or skill.

The suspension harness which is used to support this shell in a spaced relationship with respect to the head of the wearer also becomes soiled through contact with hair oils and the working environment. For this reason, it is also important that the suspension harness should be easily removable so that it too can be replaced when it becomes soiled. It is, however, extremely important that the suspension harness should be securely anchored with respect to the inner shell.

A resilient mounting system is disclosed in U.S. Pat. No. 4,286,339 dated Sept. 1, 1981 issued to Peter A. Coombs. This system employs a resilient tube which is seated in a groove formed in the inner shell. In contrast to this structure, we employ simple rigid anchors which can be embedded in the inner shell. These anchors are simple to manufacture and install in that they are formed with tangs which can be driven into the body of the foam through narrow slots formed in the lower marginal edge portion.

Liners have been located between the head of the wearer and the inner surface of the inner shell. Consequently, in order to anchor the free ends of the harness with respect to the inner shell, it has been necessary to extend the webs of the harness through apertures formed in the lining. This interweaving of the liner and the suspension harness has made the removal and refitting of the lining a time-consuming and awkward procedure with the result that in practice, the linings are used without being properly anchored with respect to the inner shell and can therefore from time to time, fail to provide the required protection.

In addition because the liners are located within the inner shell, they tend to become contaminated with hair oils and the like quite rapidly because they come directly into contact with the hair of the wearers. The fabric from which liners are made tends to be thicker and more absorbent than the straps from which the suspension harness is made and is therefore more prone to contamination by hair oil and the like.

As previously indicated, the practice in securing or anchoring the free ends of the suspension harness onto the liner of a helmet has frequently involved the forming of special seats or anchoring bars to receive mating components secured to the ends of the webs of the harness.

It has been found that it is possible to mount the liner so that it is retained with respect to the assembled helmet by being clamped between the inner and outer shells when nested one in the other. As a result, the inner shell serves to space the liner from most of the hair of the wearer and consequently, the liner is not exposed to hair oils to the same extent as that experienced by liners which are located within the inner shell.

We also provide a simple form of anchoring device which serves to securely anchor the free ends of the suspension harness to the lower marginal edge of the outer surface of the inner shell. The suspension anchor has anchoring legs which penetrate the body of the inner shell. The gap formed between the inner and outer shell at the marginal edge of the inner shell is less than the depth of penetration of the anchoring legs into the shell with the result that the anchor device cannot be withdrawn when the inner shell is nested in the outer shell.

By locating the anchoring means on the outer surface of the inner shell, the anchoring means provides a protrusion on the outer surface of the inner shell which will serve to project into the liner to further secure the liner with respect to the inner shell when clamped between the inner and outer shell in use.

One of the problems with liners which are made from substantially inelastic material is that they do not conform closely to the head of the wearer in the forehead area. It is particularly important to prevent gaps forming between the liner and forehead of the wearer to prevent flames licking up between the liner and the forehead of the wearer which may tend to ignite the hair of the wearer. On the other hand, it is preferable to ensure that the apron portion of the liner which is used to bridge the gap between the helmet and the remainder of the protective clothing is loose fitting to provide an air gap between the neck and ears of the wearer which will provide thermal insulation while permitting free head movement without causing separation between the apron and the protective clothing.

Difficulty has also been experienced in mounting the tabs which are required for securing the adjustable head band to the inner shell. The present practice is to sew the tabs directly to the inner skin of the inner shell. The inner skin is made from a plastics material and is preformed to the required final configuration of the inner shell. The sewing operation is expensive and time-consuming.

We have found that it is possible to avoid the need to sew the mounting tabs to the shell merely be forming mounting slots in the shell and providing flexible locking lugs on a proximal end portion of the mounting tabs.

SUMMARY OF INVENTION

According to one aspect of the present invention, there is provided in a fireman's helmet having an outer shell and an inpact resistent inner shell, the inner shell being proportioned to fit in a close-fitting face-to-face relationship in a recess formed in the outer shell, and a liner which has an upper band portion and an apron portion extending a substantial distance below the upper band portion, the improvement wherein the upper band portion of the liner is arranged to extend around a lower marginal edge portion of the inner shell and is clamped between said lower marginal edge portion and an opposing face of the outer shell to be retained therebetween with a portion of the band portion and the apron portion extending therefrom to project the forehead, ears and neck of the wearer in use.

According to a further aspect of the present invention, there is provided a suspension anchor for securing head mounting harness to an impact resistant inner shell of a firemans's helmet or the like comprising a short strap of substantially rigid material having a sufficient length to extend through a mounting loop formed at the end of a web of the mounting harness, said strap having a pair of anchoring legs projecting therefrom at opposite ends thereof, said legs being of a sufficient length to project into the body of the inner shell to anchor the harness which is supported by the short strap in use.

According to yet another aspect of the present invention, there is provided in a fireman's helmet having having an outer shell and an inpact resistent inner shell, the inner shell being proportioned to fit in a close-fitting face-to-face relationship in a recess formed in the outer shell, and a liner which has an upper band portion and an apron portion extending a substantial distance below the upper band portion and a suspension harness consisting of a plurality of webs each having a free end, the improvement of a suspension anchor secured to each free end of the suspension harness, said suspension anchors each overlying an outer surface of the inner shell and having anchoring legs projecting into the body of the inner shell through the outer surface thereof to be embedded therein to a depth which is greater than the gap formed between the inner and outer shells thereby to prevent the removal of the suspension anchors while the inner shell is nested in the outer shell.

According to a still further aspect of the present invention, there is provided in a fireman's helmet of the type having an inner shell which consists of a skin member and a foamed plastic member which is secured to and extends over the skin member, and a plurality of head band mounting tabs for securing the head band to the skin member, the improvement of; tab mounting slots opening through the skin at spaced intervals about a perimeter of the head receiving recess of the skin, said slots being elongated and having a predetermined length in the direction of said perimeter, said head band mounting tabs each having a proximal end portion which is proportioned to pass through the tab mounting slot in which it is to be mounted in use, said proximal end portion having lugs projecting from opposite ends thereof, said lugs being foldable with respect to the distal portion of the tab between an inner position overlying the proximal end portion to permit the proximal end portion to pass through a mounting slot and an extended position projecting laterally from the proximal end in which the lugs form locking shoulders which prevent removal of the tabs from the mounting slots and means for sealing the slots after the tabs have been mounted therein to prevent passage of plastic foam therethrough during the manufacture of the inner shell.

The invention will be more clearly understood after reference to the following detailed specification read in conjunction with the drawings wherein.

Figure 1:
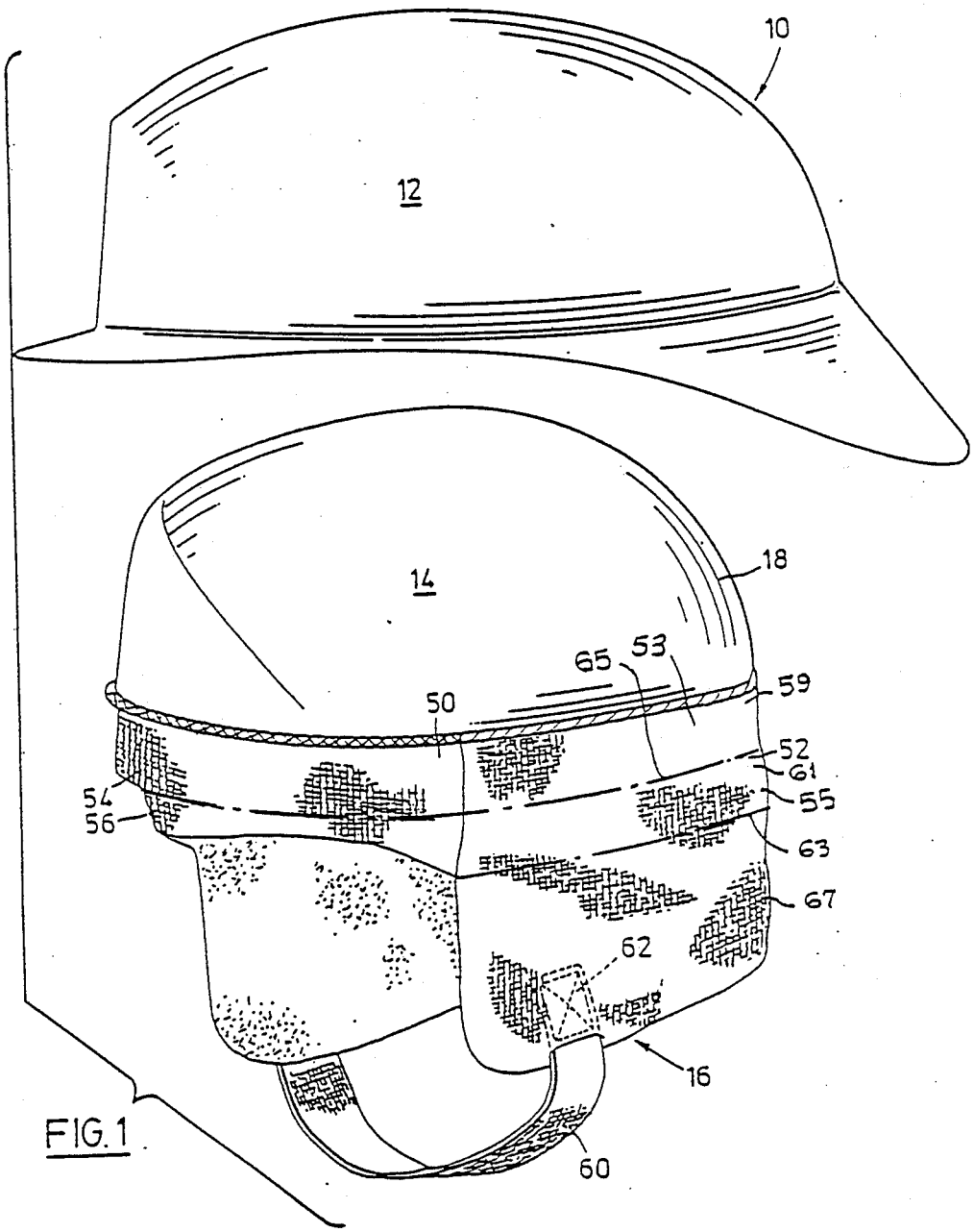
FIG. 1 is an exploded pictorial view of a fireman's helmet constructed in accordance with an embodiment of the present invention.

With reference to FIG. 1 of the drawings, the reference numeral 10 refers generally to a fireman's helmet constructed in accordance with an embodiment of the present invention. The fireman's helmet 10 includes an outer shell 12, inner shell 14 and a liner 16.

The outer shell 12 is of a conventional construction, the details of which will not therefore be described. The inner shell 14 fits within the outer shell 12 in a conventional manner.

The inner shell 14 is also largely of a conventional structure. The inner shell 14 includes a body portion 18 which is formed from a high density foam plastic material and a skin member 20 which bears against the entire inner surface of the body portion 18 and extends along the lower edge 22 and upwardly along the lower marginal edge portion 24 of the outer face 26. The body portion 18 is secured to the skin member 20 in a conventional manner.

Figure 2:
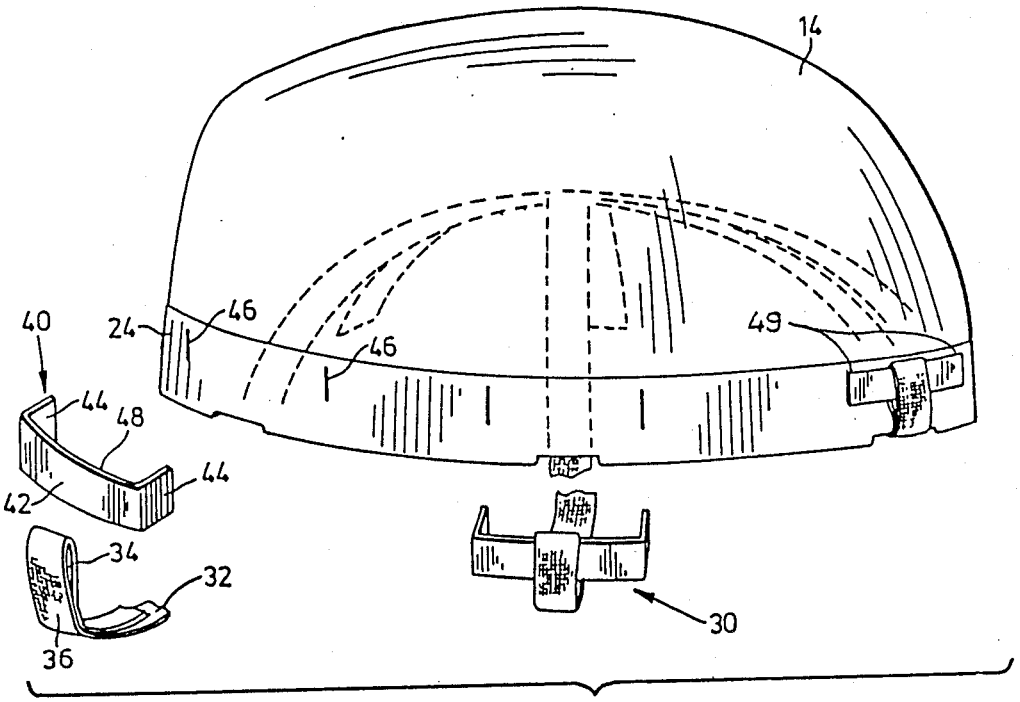
FIG. 2 is a pictorial view of the inner shell of the helmet of FIG. 1 showing the manner in which the suspension anchors are secured thereto.

The fireman's helmet also includes a suspension harness generally identified by the reference numeral 30 in FIG. 2 of the drawings.

The suspension harness 30 is of a conventional construction which includes a plurality of webs 32 each of which has a loop 34 formed at the free end 36 thereof.

For the purposes of securing the harness to the inner shell 14, a plurality of suspension anchors 40 are provided. Each suspension anchor 40 comprises a flat strap 42 which has anchoring leg portions 44 projecting from opposite ends thereof. The suspension anchors are proportioned to be threaded through the loop 34 of each web 32 so that the flat strap 42 extends through the loop 34 and the upper edge 48 supports the web 32 in use. The height of the flat strap is substantially greater than its thickness. A typical strap 42 may measure 1.5 cm. in height and 1.0 mm. in thickness, this will provide a sufficient degree of longitudinal flexibility to permit it to follow the contour of the outer face of the inner liner which also provides a substantial rigid anchor which will not bend under the load applied by the webs 32 in use. Mounting passages 46 are formed in the lower marginal edge portion 24 of the inner shell 14 to receive the anchoring legs 44. In use, the anchoring legs 44 are driven into the mounting passages 46 to secure the suspension anchors 40 therein.

The suspension anchors 40 are preferably formed from a unitary body of plastic material such as a polycarbonate material.

The liner 16 comprises a back portion 52 and a front portion 54 which are connected to one another along adjacent side edges. The front portion 54 is made from a knitted flame retardant fabric so that it is sufficiently elastic to stretch. The back portion 52 is made from a non-elastic free-retardent fabric. The liner 16 has an upper end which consists of the front portion 54 and the portion of the back portion 52 which is located above the broken line 63. This upper end of the liner 16 forms an endless band 55. As shown in FIG. 1, when the liner is mounted on the inner shell 14, the endless band 55 includes an upper portion 59 and a lower portion 61 which are located on opposite sides of the line 65 which extends along the lower edge of the inner shell 14.

The endless band 55 is proportioned so that when it is in a relaxed configuration, it has a perimeter length which is less than the perimeter length of the lower end of the inner shell 14 so that it will fit around the lower marginal edge of the inner shell 14 in a close-fitting relationship when it is extended. The lower portion 56 extends below the lower edge of the inner shell 14 and is therefore free to collapse inwardly from the shell 14. Because of the elastic nature of the front portion 54, the lower portion 56 of the front portion 54 which extends below the line 65 will be drawn inwardly and will therefore extend into contact with the forehead of the wearer forming a seal between the forehead of the wearer and the inner shell to prevent "flash over" occuring between the forehead of the wearer and the inner shell 14.

The back portion 52 includes an extension 67 which extends below the line 63 and which serves to form an apron which can be drawn in around the back of the head and the neck of the wearer by the conventional chin strap 60 which is connected to the apron by stitching 62 and has a Velcro (Trade Mark) connector for releasably securing the other end thereof to the apron 67. It will also be apparent that when the chin strap is tightened it, together with the elastic front portion 54, will tend to cause the lower portion of the upper band to collapse inwardly from the shell 14.

Figure 3:
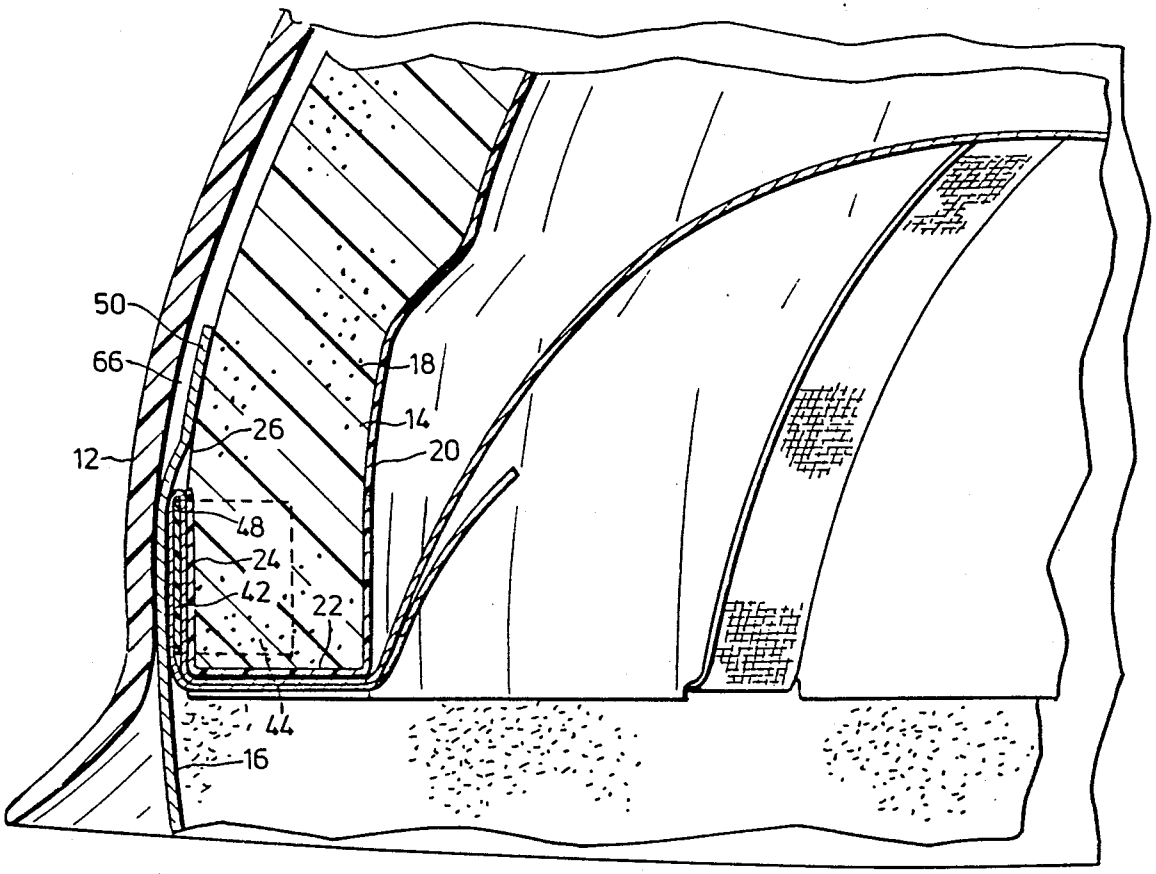
FIG. 3 is a sectional view of a portion of a helmet showing the manner in which a suspension anchor is retained.

In use, in order to assemble the helmet, the harness is first connected to the inner shell by means of anchoring devices as previously described and illustrated in FIG. 2 of the drawings. The liner is then positioned so that the upper portion 59 of the endless band 50 covers the suspension anchors 40 as shown in FIG. 1 of the drawings. The inner shell 14 is then nested within the outer shell 12 such that as shown in FIG. 3 of the drawings, the gap 66 which is formed between the inner shell 14 and outer shell 12 is narrower than the depth of penetration of the anchoring legs 44 so that it is not possible for the suspension means to withdraw the anchoring devices from the inner shell. In addition it will be noted that the upper edge 48 of the flat strap 42 forms a protrusion 49 over which the upper portion 59 of the liner 16 is drawn. The upper edge 48 serves to clamp the upper portion 59 of the liner 16 against the outer shell and consequently, not only does it serve to anchor the suspension straps but it also serves to anchor the liner 16. Thus it will be seen that the suspension anchors 40 serve the dual purpose of securing the suspension straps and securing the liner.

Figure 5:
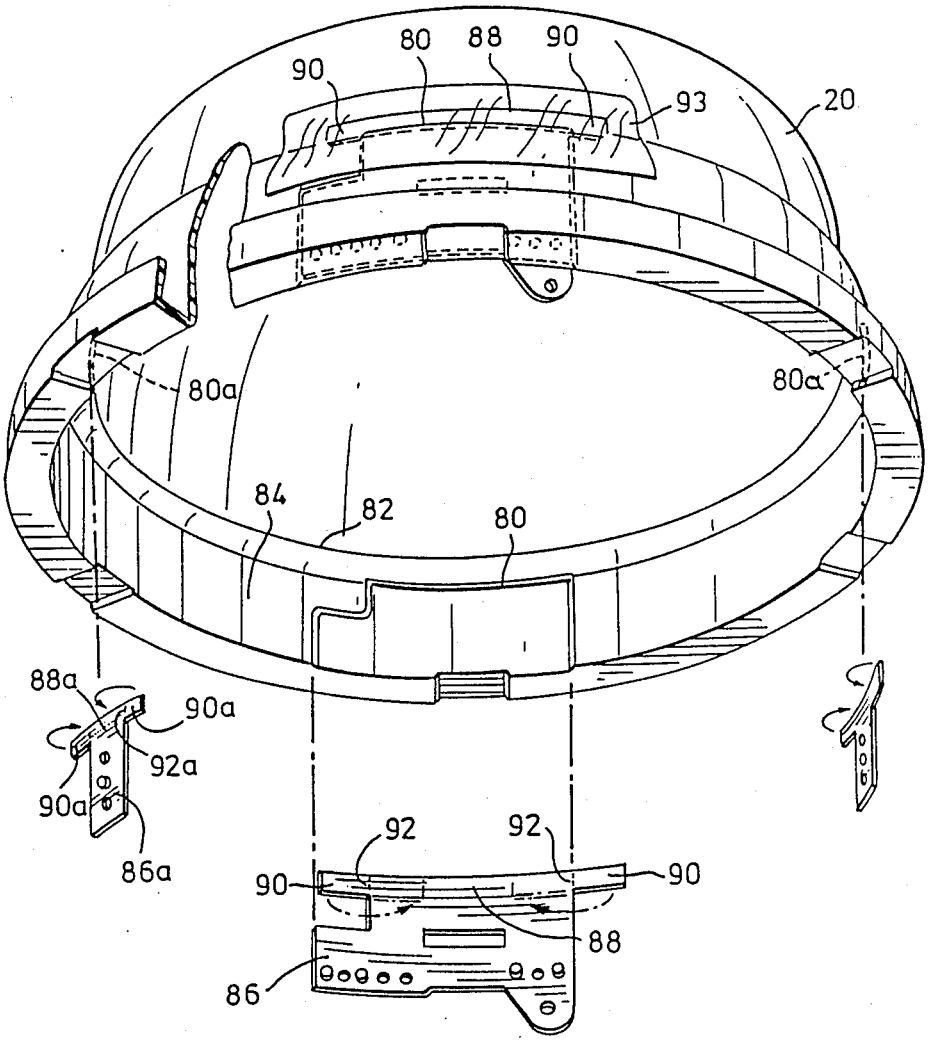
FIG. 5 is a pictorial view of the underside of a skin member of the inner shell of a fireman's helmet illustrating the head mounting tabs and their method of attachment.

As shown in FIG. 5 of the drawings, the skin member 20 is formed with a plurality of tab mounting slots 80 which are formed at spaced intervals about the perimeter line 82 of the shell which marks the upper edge of the marginal portion 84. The reference numeral 86 refers generally to a head band mounting tab which has a proximal end portion 88. Lugs 90 extend from the proximal end portion 88. The tabs 86 are made from a semi-rigid flexible plastics material which permits the tabs 90 to be resiliently folded along hinge lines 92 to assume a position in which they are located in an outwardly overlying position with respect to the proximal end 88 of the tabs 86 to permit the proximal ends 88 to pass freely through the slots 80. The tabs 90 are then folded outwardly to project laterally from opposite ends of the proximal end portion 88 so as to prevent removal of the tabs 86 from the slots 80. A web 93 of an adhesive tape such as "scotch tape" (trade mark) is applied to the outer surface of the skin member 20 after the locking tabs have been mounted in their associated slot so as to seal the slots to prevent the passage of foamed material therethrough during the subsequent foam molding process.

In FIG. 5 the reference numeral **86*a* refers generally to a headband mounting tab of the type used to connect the front and back end of the headband to the skin member 20. The headband mounting tab 86*a* has a proximal end portion 88*a*. The tab 86*a* is made from a semi-rigid flexible plastics material which permits the lugs 90*a* to be resiliently folded along hinge lines 92*a* to assume a position in which they are located in an outwardly overlying position with respect to the proximal end 88*a* to permit the proximal end 88*a* to pass freely through the slots 80*a*. The tabs 90*a* are then folded outwardly to project laterally from opposite ends of the proximal end portion 88*a* so as to prevent removal of the tabs 86*a* from the slots 80*a*. An adhesive tape is then applied to the outer surface in the manner previously described with reference to the headband mounting tab 86*a***.

From the foregoing, it will be apparent that by providing a simple mounting slot and locking lugs on a head band retaining tab, it is possible to mount and secure the head mounting tabs to the shell without requiring an expensive stitching operation.

Figure 4:
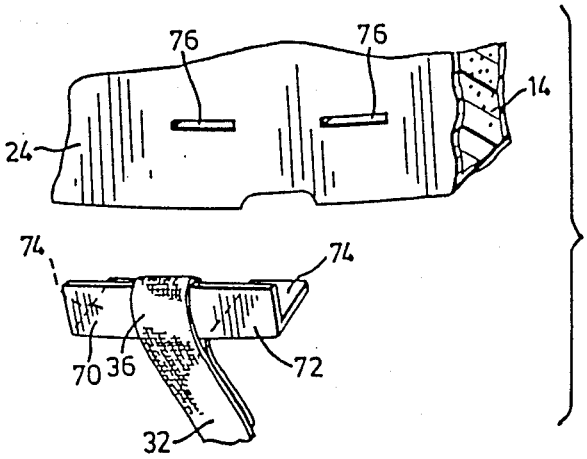
FIG. 4 is a pictorial view of an alternative form of anchoring device.

Various modifications of the present invention will be apparent to those skilled in the art. One such modification is illustrated in FIG. 4 of the drawings wherein an alternative form of suspension anchor is identified by the reference numeral 70. This suspension anchor includes a strap portion 72 which is similar to the strap portion 42. In this embodiment, however, the anchoring legs 74 project from a side edge of the strap 72 and the mounting passages 76 extend laterally of the marginal edge portion 24 of the shell 14.

These and other modifications of the present invention will be apparent to those skilled in the art.

We claim:

1. A fireman's helmet comprising;

(a) an outer shell, (b) a removable impact resistent dome-shaped inner shell, the inner shell which is free of attachment to the outer shell and proportioned to be releasably fitted in a close-fitting face-to-face relationship in a recess formed in the outer shell, and, (c) a detachable liner which has an upper end and a lower end, the upper end being in the form of an endless band and the lower end being in the form of an apron which extends downwardly form the endless band, the upper band having an upper portion and a lower portion, the upper portion of the upper band extending around a lower marginal edge portion of the inner shell and being supported thereon such that said upper portion cannot collapse inwardly from the inner shell and being releasably clamped between said lower marginal edge and an opposing face of the outer shell to be releasably retained therebetween, the lower portion of the upper band extending below the lower marginal edge of the inner shell and being free to collapse inwardly from the shell and co-operating with the apron to protect the forehead, ears and neck of the wearer in use, said inner shell being releaseable from said outer shell to permit the removal and replacement of the liner.

2. A fireman's helmet as claimed in claim 1, further comprising means on the outer surface of the inner shell forming protrusions which project into the liner to releasably retain it between the inner and outer shells as aforesaid, said protrusions being free of attachment to the outer shell.

3. A fireman's helmet as claimed in claim 1, wherein a suspension harness is mounted in the inner shell by means of suspension mounting anchors which are releaseably secured to said lower marginal edge portion of the inner shell, said anchors forming locking protrusions on the lower marginal edge portion of the inner shell which serve to bite into the upper portion of the upper band of the liner to further retain the liner, said locking protrusions being free of attachment to the outer shell.

4. A fireman's helmet as claimed in claim 1, wherein the upper band includes a forehead portion formed from an elastically stretchable material, the upper band having a relaxed length which is less than the perimeter of the lower marginal edge portion of the inner shell such that when it is mounted on the inner shell, a lower portion of the forehead portion will extend below the inner shell and will be drawn inwardly of the inner shell to bear against the forehead of the wearer in use to provide a flame retarding barrier which prevents flames passing between the inner shell and the forehead of the wearer is use.

5. A fireman's helmet as claimed in claim 1, further comprising a suspension harness comprising a plurality of webs arranged to bridge the head of the wearer in use, each web having a free end and anchor means for anchoring the free ends of the web to the lower marginal edge portion of the outer face of the inner shell, said anchor means each comprise a short strap which projects through a loop formed in the free end of each web and is arranged to overlie the outer surface of the inner shell in a face-to-face relationship therewith and a pair of anchoring legs projecting from said short strap, said anchoring legs penetrating the body of the inner shell one on either side of said free end of said web to secure the anchor means with respect to the liner.

6. In a fireman's helmet having an outer shell and an impact resistent inner dome-shaped shell, the inner shell being proportioned to fit in a close-fitting face-to-face relationship in a recess formed in the outer shell, and a suspension harness consisting of a plurality of webs each having a free end, the improvement of a suspension anchor secured to each free end of the suspension harness, said suspension anchors each overlying an outer surface of the inner shell and having anchoring legs projecting into the body of the inner shell through the outer surface thereof to be embedded therein to a depth which is greater than the gap formed between the inner and outer shells thereby to prevent the removal of the suspension anchors while the inner shell is nested in the outer shell.

7. A fireman's helmet as claimed in claim 6, wherein each suspension anchor comprises a short strap having a sufficient length to extend through a mounting loop formed at the free end of each web of the mounting harness, said anchoring legs projecting from opposite ends of said short strap so as to be embedded in the body of the inner shell as aforesaid one on either side of the free end of the suspension harness which is mounted thereon.

8. A fireman's helmet as claimed in claim 7, wherein said anchoring legs are embedded in the lower marginal edge portion of the outer face of the inner shell.

9. A fireman's helmet comprising an outer shell and an impact resistent inner dome-shaped shell, the inner shell being proportioned to fit in a close-fitting face-to-face relationship in a recess formed in the outer shell, and a liner which has an upper end and a lower end, the upper end being in the form of an endless band and the lower end being in the form of an apron which extends downwardly from the endless band, the endless band having an upper portion and a lower portion, said upper portion extending around a lower marginal edge portion of the inner shell and being clamped between said lower marginal edge portion and an opposing face of the outer shell to be retained therebetween with a portion of the lower portion of the upper end band and the apron extending therefrom to protect the forehead, ears and neck of the wearer in use, said upper end including a forehead portion formed from an elastically stretchable material, said upper end having a relaxed length which is less than the perimeter of the lower marginal edge portion of the inner shell such that when it is mounted on the inner shell, a lower portion of the forehead portion will extend below the inner shell and will be drawn inwardly of the inner shell to bear against the forehead of the wearer in use to provide a flame retarding barrier which prevents flames passing between the inner shell and the forehead of the wearer in use.

10. In a fireman's helmet having an outer shell and an inpact resistent dome-shaped inner shell, the inner shell being proportioned to fit in a close-fitting face-to-face relationship in a recess formed in the outer shell, the improvement of a liner which has an upper end and a lower end, the upper end being in the form of an endless band and the lower end being in the form of an apron which extends downwardly from the upper end, the endless band having an upper portion and a lower portion, the upper portion extending around a lower marginal edge portion of the inner shell and being clamped between said lower marginal edge portion and an opposing face of the outer shell to be retained therebetween with the lower portion of the endless band and the apron extending downwardly to protect the forehead, ears and neck of the wearer in use and a suspension harness comprising a plurality of webs arranged to bridge the head of the wearer in use, each web having a free end and anchor means for anchoring the free ends of the web to the lower marginal edge portion of the outer face of the inner shell, said anchor means each comprise a short strap which projects through a loop formed in the free end of each web and is arranged to overlie the outer surface of the inner shell in a face-to-face relationship therewith and a pair of anchoring legs projecting from said short strap, said anchoring legs penetrating the body of the inner shell one on either side of said free end of said web to secure the anchor means with respect to the liner.

11. A fireman's helmet as claimed in claim 10, wherein the endless band includes a forehead portion which is made from a knitted flame retardent fabric.

12. A fireman's helmet as claimed in claim 11, wherein the apron is made from a substantially nonelastic thermal insulating flame resistant material so as to provide a loose fitting cover for the ears and the back of the neck of the wearer.

* * * * *